US006369770B1

(12) United States Patent
Gothard et al.

(10) Patent No.: US 6,369,770 B1
(45) Date of Patent: Apr. 9, 2002

(54) CLOSELY SPACED ANTENNA ARRAY

(75) Inventors: Griffin K. Gothard, Satellite Beach; William Robert Palmer, Melbourne; Christopher A. Snyder, Palm Bay; Bing Chiang, Melbourne, all of FL (US)

(73) Assignee: Tantivy Communications, Inc., Melbourne, FL (US)

( * ) Notice: Subject to any disclaimer, the term of this patent is extended or adjusted under 35 U.S.C. 154(b) by 0 days.

(21) Appl. No.: 09/773,254

(22) Filed: Jan. 31, 2001

(51) Int. Cl.[7] ..... H01Q 21/00

(52) U.S. Cl. ..... 343/794; 343/799; 343/802; 343/810; 343/820

(58) Field of Search ..... 343/700 MS, 702, 343/793, 794, 799, 801, 802, 810, 813, 814, 816, 820, 821, 829, 846, 847

(56) References Cited

U.S. PATENT DOCUMENTS

| | | | | | |
|---|---|---|---|---|---|
| 3,854,140 | A | * | 12/1974 | Ranghelli et al. | 343/756 |
| 4,125,839 | A | | 11/1978 | Kaloi | 343/700 |
| 4,410,893 | A | * | 10/1983 | Griffee | 343/792 |
| 4,471,493 | A | | 9/1984 | Schober | 455/90 |
| 4,475,111 | A | | 10/1984 | Gittinger et al. | 343/881 |
| 4,608,572 | A | | 8/1986 | Blakney et al. | 343/792.5 |
| 4,827,271 | A | | 5/1989 | Berneking et al. | 343/700 |
| 4,853,704 | A | | 8/1989 | Diaz et al. | 343/767 |
| 5,010,349 | A | | 4/1991 | Mizuno et al. | 343/700 |
| 5,121,127 | A | | 6/1992 | Toriyama | 343/700 |
| 5,173,715 | A | * | 12/1992 | Rodal et al. | 343/795 |
| 5,210,542 | A | | 5/1993 | Pett et al. | 343/700 |
| 5,216,430 | A | | 6/1993 | Rahm et al. | 343/700 |
| 5,245,349 | A | | 9/1993 | Harada | 343/700 |
| 5,274,391 | A | * | 12/1993 | Connolly | 343/820 |
| 5,400,040 | A | | 3/1995 | Lane et al. | 343/700 |
| 5,434,575 | A | | 7/1995 | Jelinek et al. | 342/365 |
| 5,442,366 | A | | 8/1995 | Sanford | 343/700 |
| 5,519,408 | A | | 5/1996 | Schnetzer | 343/767 |
| 5,691,734 | A | * | 11/1997 | Davies | 343/795 |
| 5,936,590 | A | * | 8/1999 | Funder | 343/795 |
| 5,990,836 | A | | 11/1999 | Bhattacharyya | 343/700 |
| 5,995,048 | A | | 11/1999 | Smithgall et al. | 343/700 |
| 6,094,177 | A | | 7/2000 | Yamamoto | 343/806 |
| 6,100,855 | A | | 8/2000 | Vinson et al. | 343/846 |
| 6,111,552 | A | | 8/2000 | Gasser | 343/873 |
| 6,114,996 | A | | 9/2000 | Nghiem | 343/700 |
| 6,121,932 | A | | 9/2000 | McCoy et al. | 343/700 |
| 6,140,965 | A | | 10/2000 | Van Hoozen | 343/700 |
| 6,181,291 | B1 | * | 1/2001 | Anderson | 343/816 |

* cited by examiner

*Primary Examiner*—Tho G. Phan
(74) *Attorney, Agent, or Firm*—Hamilton, Brook, Smith & Reynolds, P.C.

(57) ABSTRACT

An antenna array for use with a mobile subscriber unit in a wireless network communications system. The invention utilizes a multiplicity of resonant strips provided within the ground plane. These strips couple to an equal multiplicity of monopole array elements located on top of the ground plane. This approach increases antenna gain by more efficiently utilizing the available ground plane area. Additionally, since the active element is on top of the ground plane, the antenna array sensitivity is decreased because the direct coupling between the antenna and external environmental factors is minimized. The multiplicity of antenna elements are electrically isolated from the ground plane. Each antenna element has a bottom end located proximal to the ground plane, and is aligned along a respective antenna axis that is substantially perpendicular to the top side. Each resonant strip has a top end electrically connected to the ground plane and a bottom end spaced apart from a bottom side of the ground plane, and is aligned along the antenna axis of a corresponding antenna element. The multiplicity of antenna elements and the multiplicity of resonant strips are equally spaced about the perimeter of the ground plane, and the combination of each antenna element with a respective resonant strip provides a unbalanced dipole antenna element so that the multiplicity of dipole antenna elements form a composite beam which may be positionally directed along a horizon that is substantially parallel to the ground plane.

32 Claims, 6 Drawing Sheets

CLOSELY SPACED ANTENNA ARRAY

BACKGROUND OF THE INVENTION

Code Division Multiple Access (CDMA) communication systems may be used to provide wireless communication between a base station and one or more subscriber units. The base station is typically a computer controlled set of switching transceivers that are interconnected to a land-based public switched telephone network (PSTN). The base station includes an antenna apparatus for sending forward link radio frequency signals to the mobile subscriber units. The base station antenna is also responsible for receiving reverse link radio frequency signals transmitted from each mobile unit. Each mobile subscriber unit also contains an antenna apparatus for the reception of the forward link signals and for transmission of the reverse link signals. A typical mobile subscriber unit is a digital cellular telephone handset or a personal computer coupled to a wireless cellular modem.

The most common type of antenna used to transmit and receive signals at a mobile subscriber unit is a omnidirectional monopole antenna. This type of antenna consists of a single wire or antenna element that is coupled to a transceiver within the subscriber unit. The transceiver receives reverse link signals to be transmitted from circuitry within the subscriber unit and modulates the signals onto the antenna element at a specified frequency assigned to that subscriber unit. Forward link signals received by the antenna element at a specified frequency are demodulated by the transceiver and supplied to processing circuitry within the subscriber unit. In CDMA cellular systems, multiple mobile subscriber units may transmit and receive signals on the same frequency and use coding algorithms to detect signaling information intended for individual subscriber units on a per unit basis.

The transmitted signal sent from a monopole antenna is omnidirectional in nature. That is, the signal is sent with the same signal strength in all directions in a generally horizontal plane. Reception of signals with a monopole antenna element is likewise omnidirectional. A monopole antenna does not differentiate in its ability to detect a signal on one direction versus detection of the same or a different signal coming from another direction.

SUMMARY OF THE INVENTION

Various problems are inherent in prior art antennas used on mobile subscriber units in wireless communications systems. Typically, an antenna array with scanning capabilities consists of a number of antenna elements located on top of a ground plane. For the subscriber unit to satisfy portability requirements, the ground plane must be physically small. For example, in cellular communication applications, the ground plane is typically smaller than the wavelength of the transmitted and received signals. Because of the interaction between the small ground plane and the antenna elements, which are typically monopole elements, the peak strength of the beam formed by the array is elevated above the horizon, for example, by about 30°, even though the beam itself is directed along the horizon. Correspondingly the strength of the beam along the horizon is about 3 db less than the peak strength. Generally, the subscriber units are located at large distances from the base stations such that the angle of incidence between the subscriber unit and the base station is approximately zero. The ground plane would have to be significantly larger than the wavelength of the transmitted/received signals to be able to bring the peak beam down towards the horizon. For example, in an 800 Mhz system, the ground plane would have to be significantly larger than 14 inches in diameter, and in a PCS system operating at about 1900 Mhz, the ground plane would have to be significantly larger than about 6.5 inches in diameter. Ground planes with such large sizes would prohibit using the subscriber unit as a portable device.

Another disadvantage of existing prior art antennas utilizing flat ground planes is that as the ground plane dimensions are reduced in size, the array input impedance becomes highly sensitive to the environment, for example, when the array is placed on a metal surface or table, because the external environment directly couples with the antenna. That is, the external environment becomes part of the antenna. If the dimensions of the ground plane are increased to a sufficient size, this coupling problem is minimized. However, the large size of these ground plans may be undesirable in many applications. Shaped ground planes have been used to pull the beam of monopole arrays down towards the horizon. These shaped ground planes have large three dimensional features. Thus, it is desirable to force the beam down towards the horizon with an antenna structure that is not too large and unwieldy.

The present invention greatly reduces problems encountered by the aforementioned prior art antenna systems. The present invention provides an inexpensive antenna array for use with a mobile subscriber unit in a wireless same frequency network communications system, such as CDMA cellular communication networks. The invention utilizes a multiplicity of resonant strips provided within the ground plane. These strips couple to an equal multiplicity of monopole array elements located on top of the ground plane. This approach increases antenna gain by more efficiently utilizing the available ground plane area. Additionally, since the active element is on top of the ground plane, the antenna array sensitivity is decreased because the direct coupling between the antenna and external environmental factors is minimized.

The multiplicity of antenna elements are electrically isolated from the ground plane. Each antenna element has a bottom end located proximal to the ground plane, and is aligned along a respective antenna axis that is substantially perpendicular to the top side. Each resonant strip has a top end electrically connected to the ground plane and a bottom end spaced apart from a bottom side of the ground plane, and is aligned along the antenna axis of a corresponding antenna element. The multiplicity of antenna elements and the multiplicity of resonant strips are equally spaced about the perimeter of the ground plane, and the combination of each antenna element with a respective resonant strip provides a unbalanced dipole antenna element so that the multiplicity of dipole antenna elements form a composite beam which may be positionally directed along a horizon that is substantially parallel to the ground plane. Typically, at least one antenna element is connected to a transmission feed line for receiving signals from and transmitting signals to the antenna element.

Embodiments of this aspect can include one or more of the following features. The ground plane can be cylindrical such that the top side of the ground plane is a planar end of the cylinder, and the bottom side of the ground plane is an opposite planar end of the cylinder. In this arrangement, each resonant strip is disposed within a respective slot of the ground plane. The walls of each slot are spaced apart from the surface of the resonant strip, and the space between the walls and the surface is filled with nonmetallic material to electrically isolate a non-top end portion of the resonant strip from the ground plane. The ground plane, the antenna elements, and the resonant strips are made of copper, and the nonmetallic material is typically made of PCB materials such as polystyrene or Teflon.

The ground plane can be made of a multiplicity of plates equal in number to the multiplicity of resonant strips. Each plate has an outer edge and an inner edge. The resonant strips are aligned along the outer edge of a respective plate, and the inner edges of the plates are joined together at the center of the ground plane forming a central joint with an axis that is substantially parallel to the axes of the resonant strips. The central joint is a hinge which facilitates collapsing the antenna apparatus into a flat compact unit. Each plate includes a first nonmetallic substrate and a first conductive material layered over one side of the substrate. The conductive portion of the ground plane and the resonant strips are made of that conductive material. The nonmetallic substrate can be made from PCB materials such as polystyrene or Teflon, and the conductive material can be copper. Each plate can include a second nonmetallic substrate, a second conductive material sandwiched between the first substrate layer and the second substrate layer, and a third conductive material layered on an opposite side of the second nonmetallic substrate. The conductive portion of the ground plane and the resonant strips can be made of the first conductive material and the third conductive material.

In either of the above configurations, at least one antenna element can be connected to a phase shifter. The phase shifters are independently adjustable to affect the phase of respective signals transmitted from the antenna apparatus. Alternatively, at least one antenna element is connected to a delay line. The antenna element can be connected to a lumped or variable impedance element and/or a switch. Ideally, the peak strength of the directed beam rises no more than about 10° above the horizon. In some arrangements, the directed beam rises no more than about 5°, or even less, for example, 0°.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1B:
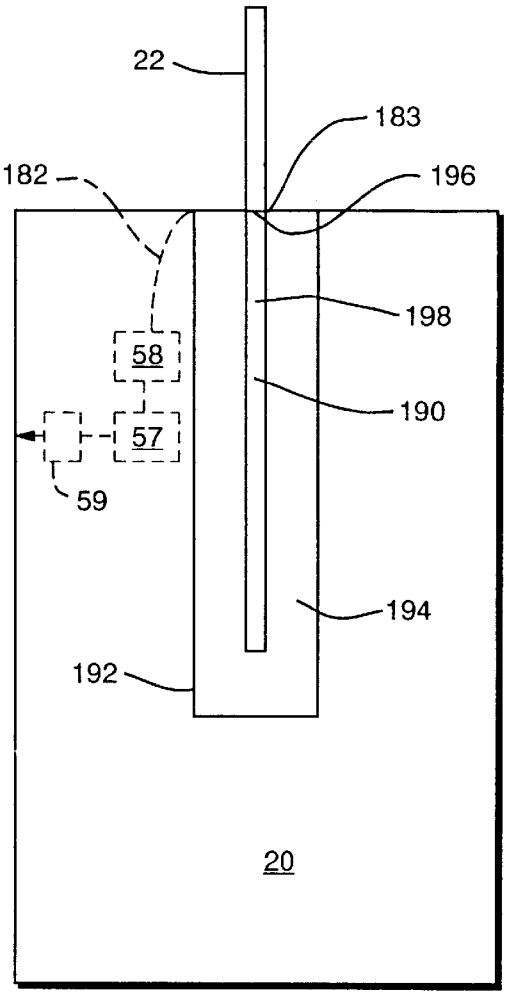
FIG. 1B is a close-up cutaway view of an antenna element of the antenna array of FIG. 1A.

A description of preferred embodiments of the invention follows. Turning now to the drawings, there is shown in FIG. 1 an antenna apparatus 10 configured according to the present invention. Antenna apparatus 10 serves as the means by which transmission and reception of radio signals is accomplished by a subscriber unit 11, such as a laptop computer 14 coupled to a wireless cellular modem, with a base station 12. The subscriber unit provides wireless data and/or voice services and can connect devices such as the laptop computer 14, or personal digital assistants (PDAs) or the like through the base station 12 to a network which can be a Public Switched Telephone Network (PSTN), a packet switched computer network, or other data network such as the Internet or a private intranet. The base station 12 may communicate with the network over any number of different efficient communication protocols such as primary ISDN, or even TCP/IP if the network is an Ethernet network such as the Internet. The subscriber unit may be mobile in nature and may travel from one location to another while communicating with base station 12. In the typical scenario, a number of subscriber access units 11 are located within the area surrounding the base station 12 and are serviced by the common base station. However, other arrangements are possible.

It is also to be understood by those skilled in the art that FIG. 1 may be a standard cellular type communication system such as CDMA, TDMA, GSM or other systems in which the radio channels are assigned to carry data and/or voice signals between the base station 12 and the subscriber unit 14. In a preferred embodiment, FIG. 1 is a CDMA-like system, using code division multiplexing principles such as those defined in U.S. Pat. No. 6,151,332.

Antenna apparatus 10 includes a cylindrically shaped base or ground plane 20 upon which are mounted six antenna elements 22. As illustrated, the antenna apparatus 10 is coupled to the laptop computer 14 (not drawn to scale). The antenna apparatus 10 allows the laptop computer 14 to perform wireless communications via forward link signals 30 transmitted from the base station 12 and reverse link signals 32 transmitted to the base station 12.

In a preferred embodiment, each antenna element 22 is disposed on the ground plane 20 in the dispersed manner as illustrated in the figure. That is, a preferred embodiment includes five elements which are equally spaced about the perimeter of the ground plane 20 and a sixth element is positioned at a location corresponding to a center of the ground plane 20.

Figure 2A:
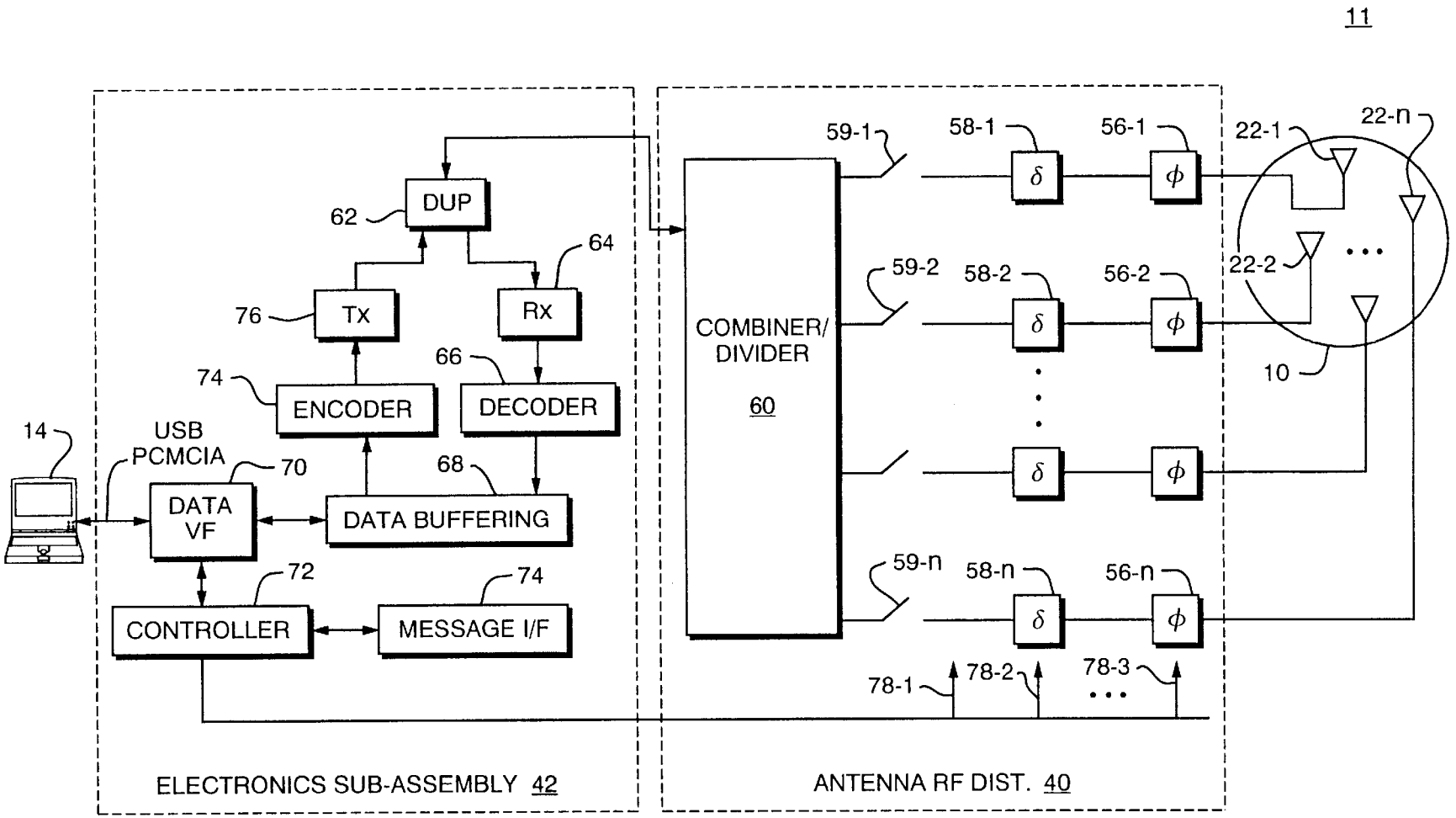
FIG. 2A is a system level diagram for the electronics used to control the antenna array.

Turning attention to FIG. 2A, there is shown a block diagram of the electronics which control the subscriber access unit 11. The subscriber access unit 11 includes the antenna array 10, antenna Radio Frequency (RF) subassembly 40, and an electronics sub-assembly 42. Wireless signals arriving from the base station 12 are first received at the antenna array 10 which consists of the antenna elements 22-1, 22-2, . . . , 22-N. The signals arriving at each antenna element are fed to the RF subassembly 40, including, for example, a phase shifter 56, delay 58, and/or switch 59. There is an associated phase shifter 56, delay 58, and/or switch 59 associated with each antenna element 22.

The signals are then fed through a combiner divider network 60 which typically adds the energy in each signal chain providing the summed signal to the electronics subassembly 42.

In the transmit direction, radio frequency signals provided by the electronic sub-assembly 42 are fed to the combiner divider network 60. The signals to be transmitted follow through the signal chain, including the switch 59, delay 58, and/or phase shifter 56 to a respective one of the antenna elements 22, and from there are transmitted back towards the base station.

In the receive direction, the electronics sub-assembly 42 receives the radio signal at the duplexer filter 62 which provides the received signals to the receiver 64. The radio receiver 64 provides a demodulated signal to a decoder circuit 66 that removes the modulation coding. For example, such decoder may operate to remove Code Division Multiple Access (CDMA) type encoding which may involve the use of pseudorandom codes and/or Walsh codes to separate the various signals intended for particular subscriber units, in a manner which is known in the art. The decoded signal is then fed to a data buffering circuit 68 which then feeds the decoded signal to a data interface circuit 70. The interface circuit 70 may then provide the data signals to a typical computer interface such as may be provided by a Universal Serial Bus (USB), PCMCIA type interface, serial interface or other well-known computer interface that is compatible with the laptop computer 14. A controller 72 may receive and/or transmit messages from the data interface to and from a message interface circuit 74 to control the operation of the decoder 66, an encoder 74, the tuning of the transmitter 76 and receiver 64. This may also provide the control signals 78 associated with controlling the state of the switches 59, delays 58, and/or phase shifters 56. For example, a first set of control signals 78-3 may control the phase shifter states such that each individual phase shifter 56 imparts a particular desired phase shift to one of the signals received from or transmitted by the respective antenna element 22. This permits the steering of the entire antenna array 10 to a particular desired direction, thereby increasing the overall available data rate that may be accomplished with the equipment. For example, the access unit 11 may receive a control message from the base station commanded to steer its array to a particular direction and/or circuits associated with the receiver 64 and/or decoder 66 may provide signal strength indication to the controller 72. The controller 72 in turn, periodically sets the values for the phase shifter 56.

Figure 1A:
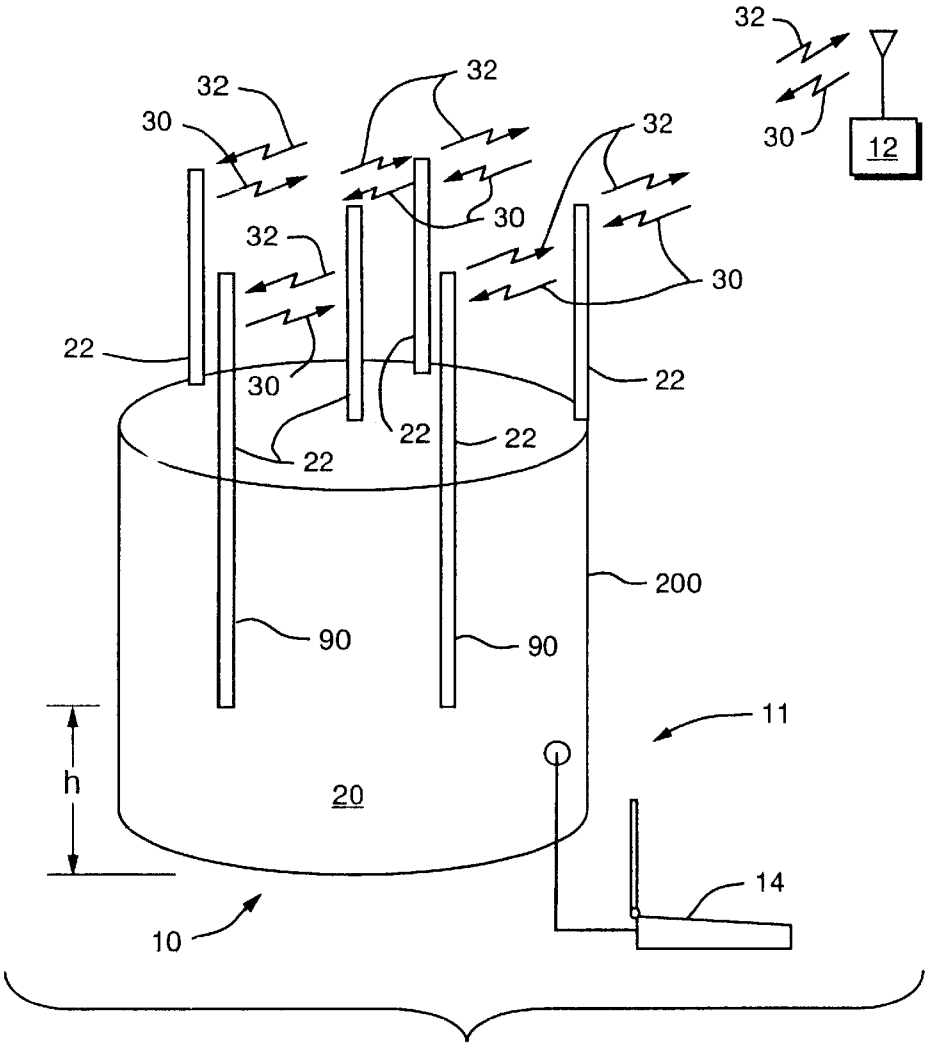
FIG. 1A is an isometric view of antenna array used by a mobile subscriber unit in a cellular system according to this invention.
Figure 2B:
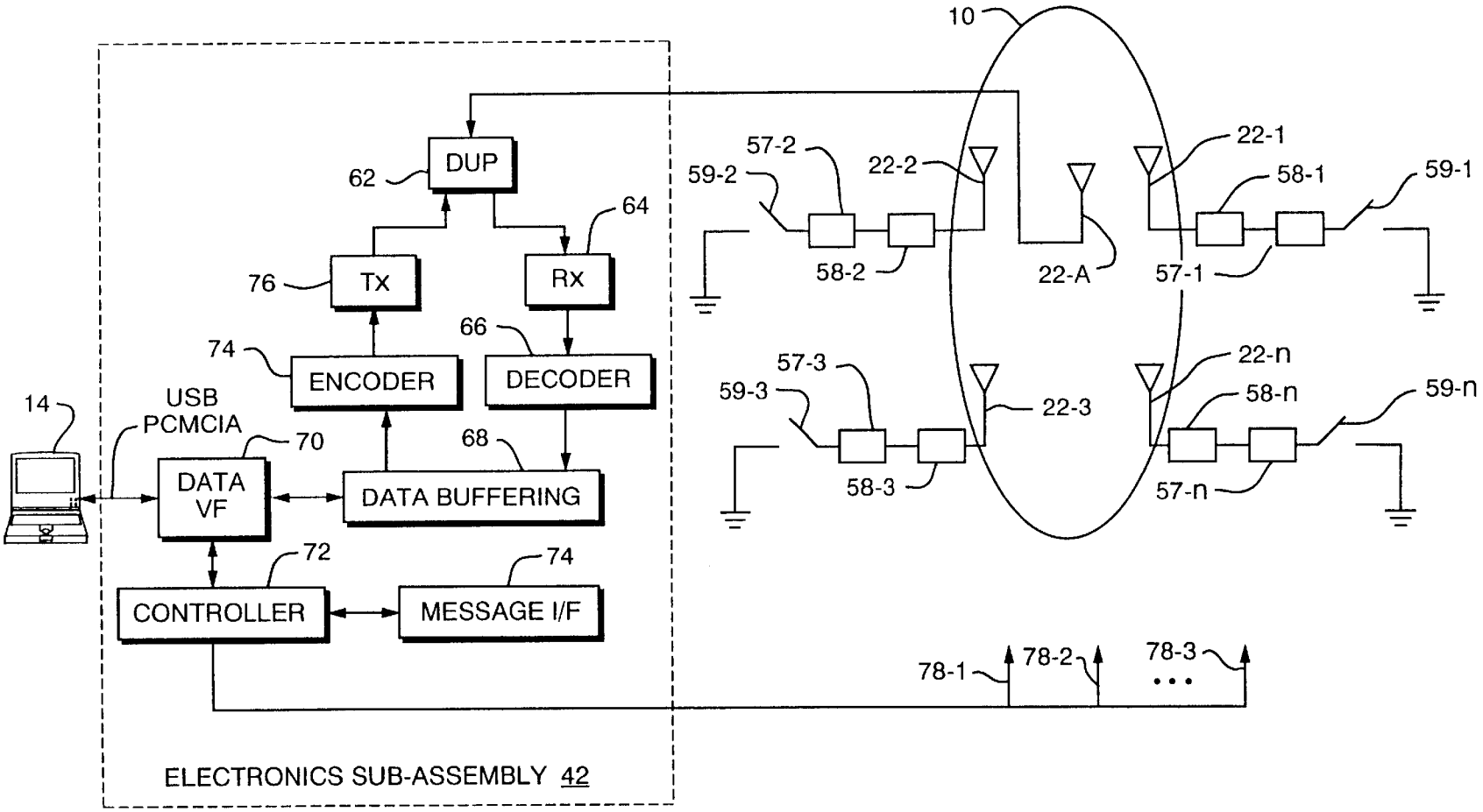
FIG. 2B is a system level diagram for an alternative arrangement of the electronics used to control the antenna array.

Referring now to FIG. 2B, there is shown an alternative arrangement for the antenna array 10 of the access unit 11. In this configuration, a single active antenna element 22-A is positioned in the middle of the ground plane 20 and is surrounded by a set of passive antenna elements 22-1, 22-2, 22-3, . . . , 22-N. (For example, in FIG. 1A, the five outer elements are passive antenna elements for this configuration.) Here only the active antenna element 22-A is connected, directly through the duplexer filter 62, to the electronics sub-assembly 42. An associated delay 58, variable or lumped impedance element 57, and switch 59 is connected to a respective passive antenna element 22-1, 22-2, 22-3, . . . , 22-N.

In the arrangement shown in FIG. 2B, the transmit/receive signals are communicated between the base station and the active antenna element 22-A. In turn, the active antenna element 22-A provides the signals to the electronics sub-assembly 42 or receives signals from the assembly 42. The passive antenna elements 22-1, 22-2, 22-3, . . . , 22-N either reflect the signals or direct the signals to the active antenna element 22-A. The controller 72 may provide control signals 78 to control the state of the delays 58, impedance elements 57, and switches 59.

Referring now to FIG. 1B, each antenna element 22 is mounted to the top of the ground plane 20. A transmission feed line 182 is connected to the antenna element 22 at a bottom feed point 183, and to the delay line 58 which in turn is connected to the lumped or impedance element 57 and the switch 59. The antenna element 22, and the transmission feed line 182 are electrically isolated from the ground plane 20. The delay line 58, the lumped or variable impedance element 57, and the switch 59 are located within the ground plane 20 but are also electrically isolated from the ground plane. Instead of the delay line 58, the phase shifter 56 (FIG. 2A) can be connected to the antenna element 22. The phase shifter 56 of each antenna element 22 is independently adjustable to facilitate changing the phase of a signal transmitted from the antenna element 22. The transmission line 182 provides a path for transmitted signals to and received signals from the antenna element 22.

Beneath each antenna element 22 is a resonant strip 190 positioned in a slot 192 formed in the ground plane 20. The slot 192 is slightly larger in size than the resonant strip 190 to define a space 194. A top end 196 of the resonant strip 190 is electrically coupled to the ground plane 20. However, the space 194 is filled with nonmetallic material, for example, PCB materials such as polystyrene or Teflon, to electrically isolate the non-top end portion 198 of the resonant strip 190 from the ground plane 20.

Both the antenna element 22 and the resonant strip 90 are made, for example, from copper. For applications in the PCS bandwidth (1850 Mhz to 1990 Mhz), the antenna element 22 has a length of about a quarter wavelength of the operating signal and a thickness of about one-tenth a wavelength. Each resonant strip 190 is also about a quarter wavelength long and about one-tenth wavelength in thickness. The bottom of the resonant strip 190 is positioned at a height, "h," of about a one-eighth wavelength above the bottom of the ground plane 20 (FIG. 1A), although the bottom of the resonant strip 190 can be nearly touching the bottom of the ground plane 20.

Figure 3:
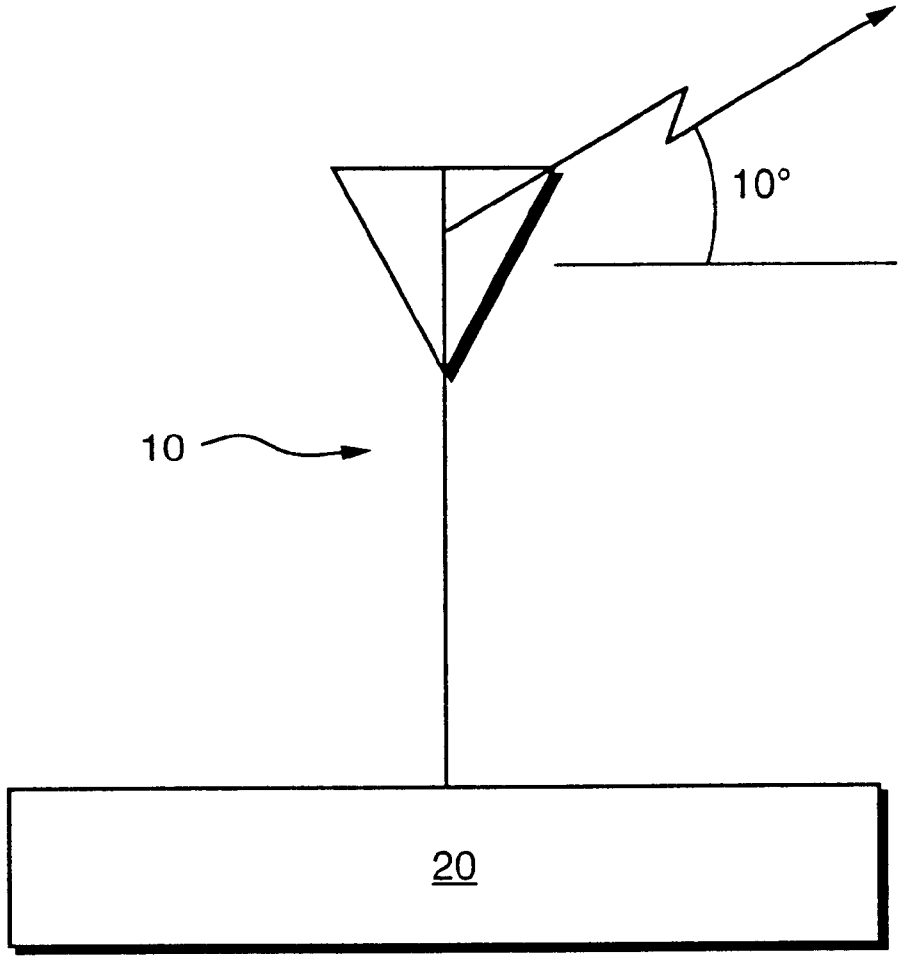
FIG. 3 illustrates a beam directed ten degrees above the horizon by an antenna element configured according to the invention.

In use, signals are transmitted to and received from the antenna element 22 along the transmission feed line 182 to enable the antenna array 10 to communicate with the base station 12. The curved outer surface 200 of the ground plane 20 brings the beam formed by the antenna array 10 down to the horizon since the surface normal of the curved surface 200 points towards the horizon. Alone, each antenna element 22 acts as a monopole element. However, because of the presence of the resonant strip 190, the antenna elements 22 couple with the resonant strips 190 to form an unbalanced dipole antenna. As such, the combination of the antenna element 22 and the resonant strip 190 provide further capabilities to direct the array beam along the horizon so that the ground plane 20 maybe reduced in size without sacrificing the beam directing capability of the antenna array 10. As an array of unbalanced dipole antenna elements, the antenna array 10, as illustrated in FIG. 3, is capable of forming a beam with a peak beam strength which rises no more than about 10° above the horizon, or even less, for example, no more than 0°.

In addition, the coupling of the antenna element 22 with the resonant strip 190 increases the effective area of the antenna and consequently the gain. And, since the antenna elements 22 are mounted on top of the ground plane 20, the antenna array sensitivity to external environmental factors (such as when the array is placed on a metallic table) is decreased because the direct coupling of the antenna element 22 to these factors is minimized.

The present invention is not limited to cylindrical ground planes. For example, referring to FIG. 4A, there is shown an alternative arrangement of an antenna array 201. The antenna array 201 includes a ground plane 202 made of six plates 204. Seven antenna elements 206 are mounted on the ground plane 202 in the manner illustrated in the figure. That is, the embodiment includes six passive director/reflector elements which are equally spaced about the perimeter of the ground plane 202 above an outer edge 208 of each plate 204, and a seventh active element is positioned at a location corresponding to a center of the ground plane 202. An inner edge 207 of each plate 204 is joined together with the other inner edges 207 at the center of the ground plane 202 to form a hinge 209. The hinge 209 can be spring loaded so that the plates 204 are collapsible to form a flat compact unit (FIG. 4C), thereby making the antenna array convenient for transporting.

Figure 4B:
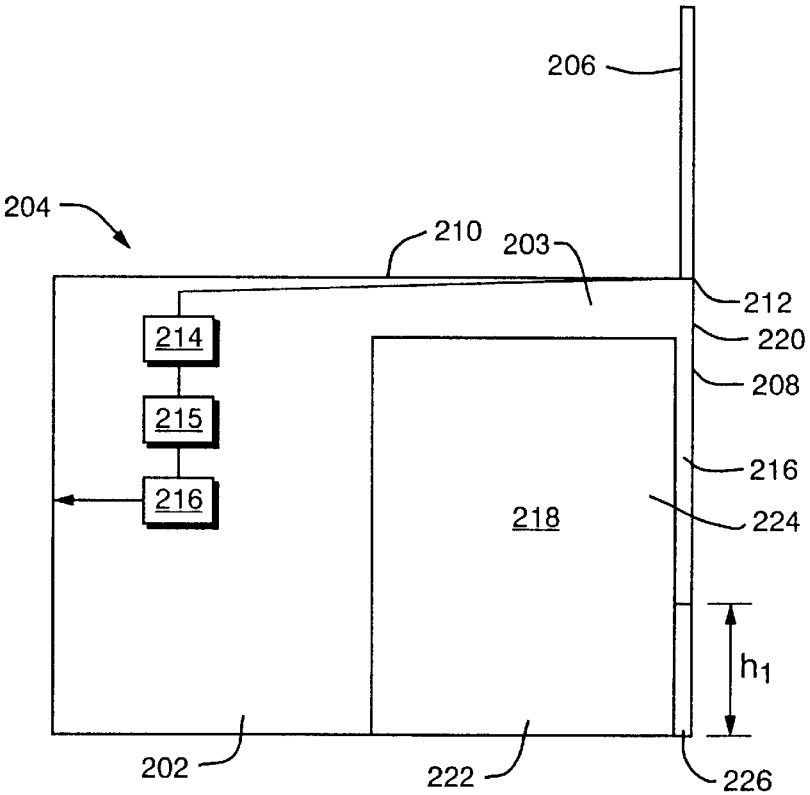
FIG. 4B is a close-up cutaway view of an antenna element of the antenna array of FIG. 3A.
Figure 4A:
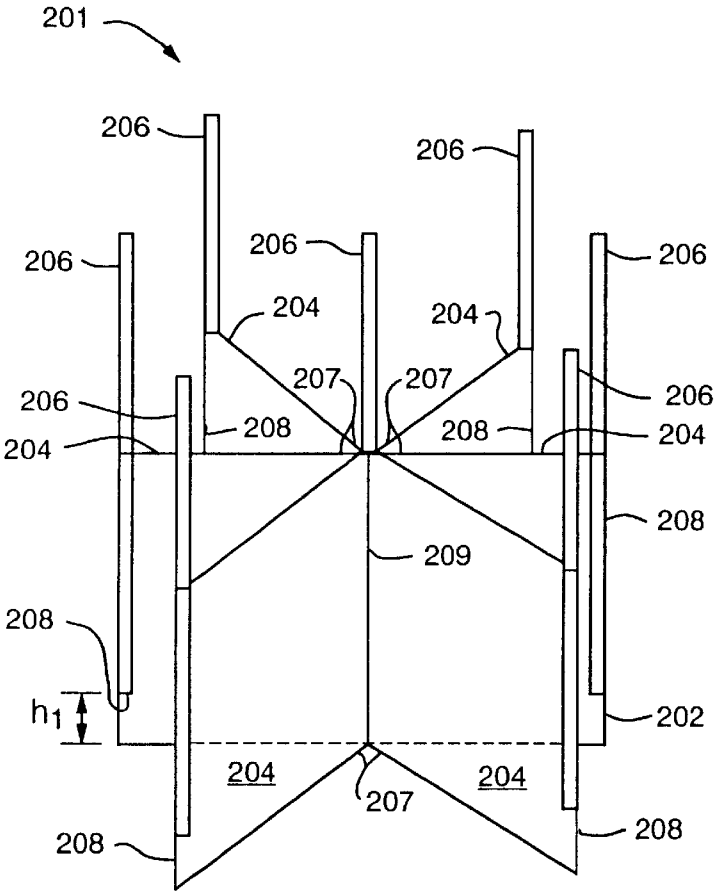
FIG. 4A is an isometric view of an alternative embodiment of an antenna array according to this invention.
Figure 4C:
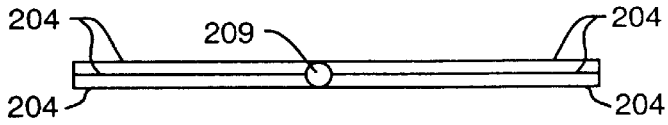
FIG. 4C is a view of the antenna array of FIG. 4A collapsed into a flat compact unit.

Referring in particular to FIG. 4B, each antenna element 206 is mounted to the top of the ground plane 202, but is electrically isolated from the ground plane 202. The antenna element 206 is connected to a transmission feed line 210 at a bottom feed point 212. Each plate 204 is provided with a delay line 214 connected to a lumped or variable impedance element 215 and a switch 216 which are connected to the antenna element 1206 through the transmission feed line 210. The transmission feed line 210, the delay line 214, the lumped or variable element 214, and the switch 216 serve the same functions as the transmission feed line 182, the delay line 58, the lumped or variable impedance element 57, and the switch 59 for the embodiment described in reference to FIGS. 1A and 1B.

Each plate 204 is also provided with a resonant strip 216 positioned along the outer edge 208 of the plate 204. A top end 220 of the resonant strip 216 is electrically coupled to the ground plane 202 by a top band 203.

Each plate 204 includes a nonmetallic dielectric substrate 222 made from, for example, PCB materials such as polystyrene or Teflon. For PCS applications, the substrate has a height of about one-third the wavelength of the operating signal, and a width of about one-quarter wavelength and is about 0.03 inch thick. The ground plane 202 and the resonant strip 216 are produced with printed circuit board (PCB) techniques by depositing on one side 218 of the substrate 222 with copper having a thickness of about 0.0015 inch, and then photo-etching the copper into the desired shapes. Thus the ground plane 202, the top band 203 and the resonant strip 216 form a continuous layer of copper surrounding an inner region 224 of the substrate 222. In addition, there is a thin region 226 of height, "$h_1$, " separating the bottom of the resonant strip 216 from the bottom of the plate 204. PCB techniques are also used to print the transmission feed line 210, the delay line 214, the lumped or variable impedance element 215, and the switch 216 on the opposite side of the substrate 222. The antenna elements 206 are also typically made from copper. The antenna elements 206 and the resonant strips 216 are about one-quarter wavelength long, and are about a one-tenth wavelength wide.

Figure 4D:
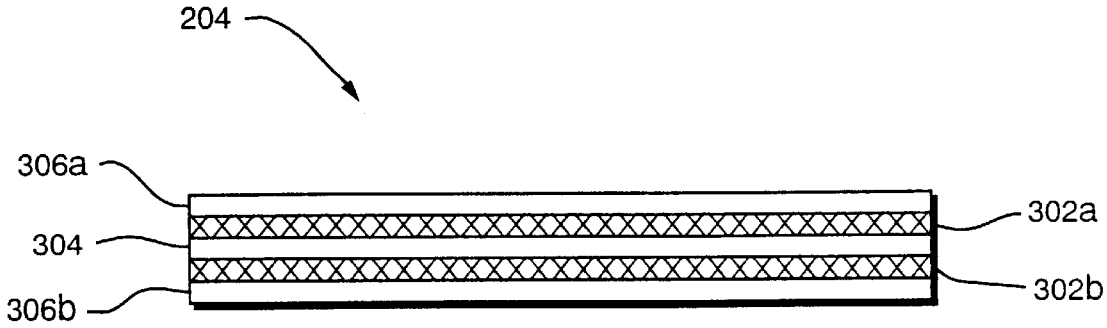
FIG. 4D an alternative configuration of the multiple layers of a plate of the antenna array.

Referring to FIG. 4D, there is shown an alternative lay-up for the plate 204. Here, a conductive material 304, for example, copper, is sandwiched between two substrates 302A and 302B made from a dielectric material. On the outer sides of the substrates 302A and 302B, there is a respective layer of conductive material 306A and 306B. The inner conductive material 304 is used for transmission line activity for the antenna element 206, as well as the delay line 214, the lumped or variable impedance element 215, and the switch 216 which are typically imbedded in one of the substrates 302A or 302B. The two outer layers of conductive material 306A and 306B serve as the ground plane 202 and the resonant strip 216.

While this invention has been particularly shown and described with references to preferred embodiments thereof, it will be understood by those skilled in the art that various changes in form and details may be made therein without departing from the scope of the invention encompassed by the appended claims.

What is claimed is:

1. An antenna apparatus for use in a wireless communication subscriber unit, comprising:

a multiplicity of antenna elements disposed above a top side of a ground plane and electrically isolated from the ground plane, each antenna element including a bottom end located proximal to the ground plane, and each antenna element also being aligned along a respective antenna axis that is substantially perpendicular to the top side; and an equal multiplicity of resonant strips positioned beneath the top side of the ground plane, each resonant strip including a top end electrically connected to the ground plane and a bottom end spaced apart from a bottom side of the ground plane, and each resonant strip being aligned along the antenna axis of a corresponding antenna element;

the multiplicity of antenna elements and the multiplicity of resonant strips being equally spaced about the perimeter of the ground plane, and the combination of each antenna element with a respective resonant strip providing an unbalanced dipole antenna element so that the multiplicity of dipole antenna elements form a composite beam which may be positionally directed along a horizon that is substantially parallel to the ground plane.

2. The antenna apparatus of claim 1, wherein the ground plane is cylindrical, the top side of the ground plane being a planar end of the cylinder, and the bottom side of the ground plane being an opposite planar end of the cylinder.

3. The antenna apparatus of claim 2, wherein each resonant strip is disposed within a respective slot of the ground plane, the walls of each slot being spaced apart from the surface of the respective resonant strip, and the space between the walls and the surface being filled with nonmetallic material to electrically isolate a non-top end portion of the resonant strip from the ground plane.

4. The antenna apparatus of claim 3, wherein the nonmetallic material is made of a PCB material.

5. The antenna apparatus of claim 3, wherein the nonmetallic material is made of polystyrene.

6. The antenna apparatus of claim 3, wherein the nonmetallic material is made of Teflon.

7. The antenna apparatus of claim 2, wherein the ground plane, the antenna elements, and the resonant strips are made of copper.

8. The antenna apparatus of claim 2, wherein at least one antenna element is connected to a phase shifter located within the ground plane, the phase shifters being independently adjustable to affect the phase of respective signals transmitted from the antenna elements.

9. The antenna apparatus of claim 2, wherein at least one antenna element is connected to a delay line.

10. The antenna apparatus of claim 2, wherein at least one antenna element is connected to a lumped impedance element.

11. The antenna apparatus of claim 2, wherein at least one antenna element is connected to a variable impedance element.

12. The antenna apparatus of claim 2, wherein at least one antenna element is connected to a switch.

13. The antenna apparatus of claim 2, wherein at least one antenna element is connected to a delay line, a lumped impedance element, and a switch.

14. The antenna apparatus of claim 2, wherein at least one antenna element is connected to a delay line, a variable impedance element, and a switch.

15. The antenna apparatus of claim 1, wherein the ground plane is made of a multiplicity of plates equal in number to the multiplicity of resonant strips, each plate having an outer edge and an inner edge, the resonant strips being aligned along the outer edge of a respective plate, and the inner edges of the plates being joined together at the center of the ground plane forming a central joint with an axis that is substantially parallel to the axes of the resonant strips.

16. The antenna apparatus of claim 15, wherein the central joint is a hinge which facilitates collapsing the antenna apparatus into a flat compact unit.

17. The antenna apparatus of claim 15, wherein each plate includes a first nonmetallic substrate and a first conductive material layered over one side of the first substrate, a conductive portion of the ground plane and the resonant strips being made of the first conductive material.

18. The antenna apparatus of claim 17, wherein the nonmetallic substrate is made of a PCB material.

19. The antenna apparatus of claim 17, wherein the nonmetallic substrate is made of polystyrene.

20. The antenna apparatus of claim 17, wherein the nonmetallic substrate is made of Teflon.

21. The antenna apparatus of claim 17, wherein the conductive material and the antenna elements are made of copper.

22. The antenna apparatus of claim 17, wherein each plate includes a second nonmetallic substrate, a second conductive material sandwiched between the first substrate and the second substrate, and a third conductive material layered on an opposite side of the second nonmetallic substrate, the conductive portion of the ground plane and the resonant strips being made of the first conductive material and the third conductive material.

23. The antenna apparatus of claim 15, wherein at least one antenna element is connected to a phase shifter, the phase shifters being independently adjustable to affect the phase of respective signals transmitted from the antenna apparatus.

24. The antenna apparatus of claim 15, wherein at least one antenna element is connected to a delay line.

25. The antenna apparatus of claim 15, wherein at least one antenna element is connected to a lumped impedance element.

26. The antenna apparatus of claim 15, wherein at least one antenna element is connected to a variable impedance element.

27. The antenna apparatus of claim 15, wherein at least one antenna element is connected to a delay line, a lumped impedance element, and a switch.

28. The antenna apparatus of claim 15, wherein at least one antenna element is connected to a delay line, a variable impedance element, and a switch.

29. The antenna apparatus of claim 1, wherein at least one antenna element is connected to a transmission feed line for receiving signals from and transmitting signals to the antenna element.

30. The antenna apparatus of claim 1, wherein the directed beam rises above the horizon at an angle of about 10°.

31. The antenna apparatus of claim 1, wherein the directed beam rises above the horizon at an angle of about 5°.

32. The antenna apparatus of claim 1, wherein the directed beam rises above the horizon at an angle of about 0°.

* * * * *